US012496480B2

(12) United States Patent
Til

(10) Patent No.: US 12,496,480 B2
(45) Date of Patent: Dec. 16, 2025

(54) VARIABLE FORCE PNEUMATIC EXERCISE STAFF AND METHOD

(71) Applicant: Philippe Til, Woodland Hills, CA (US)

(72) Inventor: Philippe Til, Woodland Hills, CA (US)

( * ) Notice: Subject to any disclaimer, the term of this patent is extended or adjusted under 35 U.S.C. 154(b) by 243 days.

(21) Appl. No.: 18/278,792

(22) PCT Filed: Feb. 22, 2022

(86) PCT No.: PCT/US2022/017392

§ 371 (c)(1),
(2) Date: Aug. 24, 2023

(87) PCT Pub. No.: WO2022/182685

PCT Pub. Date: Sep. 1, 2022

(65) Prior Publication Data

US 2024/0131379 A1 Apr. 25, 2024
US 2024/0226634 A9 Jul. 11, 2024

Related U.S. Application Data

(60) Provisional application No. 63/153,228, filed on Feb. 24, 2021.

(51) Int. Cl.
*A63B 21/00* (2006.01)

(52) U.S. Cl.
CPC .... *A63B 21/00189* (2013.01); *A63B 21/4035* (2015.10); *A63B 21/4049* (2015.10)

(58) Field of Classification Search
CPC ..... A63B 21/0004; A63B 21/00069; A63B 21/00076; A63B 21/00189; A63B 21/008;
(Continued)

(56) References Cited

U.S. PATENT DOCUMENTS 767,008 A * 8/1904 Pelletier ..... A63B 21/0004 482/112
3,174,343 A * 3/1965 Kasulis ..... A63B 21/0087 482/112

(Continued)

FOREIGN PATENT DOCUMENTS

AU 2009101024 A4 * 11/2009 ..... A63B 21/0087
CN 112076433 A * 12/2020 ..... A63B 21/045

(Continued)

OTHER PUBLICATIONS

BullWorker products webpage; https://www.bullworker.com/shop/; accessed Jun. 18, 2024.

*Primary Examiner* — Gary D Urbiel Goldner
(74) *Attorney, Agent, or Firm* — Lance M. Pritikin

(57) ABSTRACT

An exemplary variable force pneumatic exercise staff comprises at least one staff segment including a pneumatic cylinder and a handle element. The pneumatic cylinder is elongated and has a handle engagement end and a staff first end disposed oppositely of one another. The pneumatic cylinder is actuatable between a compressed configuration and an extended configuration such that a cylinder length is greater in the extended configuration than in the compressed configuration. The handle element is affixed to the handle engagement end. The cylinder is configured to user-adjustably provide an extension resistance force for resisting the actuation toward the extended configuration, and a compression resistance force for resisting the actuation toward the compressed configuration. The cylinder may include a resistance controller allowing a user to manually adjust the extension and compression resistance forces. A segment coupler may be configured to rigidly couple the staff segment to a second staff segment.

27 Claims, 14 Drawing Sheets

(58) Field of Classification Search
CPC ..... A63B 21/0083; A63B 21/0085; A63B 21/0087; A63B 21/023; A63B 21/0428; A63B 21/045; A63B 21/0455; A63B 21/05; A63B 21/072; A63B 21/4035; A63B 21/4045; A63B 21/4049; A63B 23/12; A63B 23/1209; A63B 24/0087; A63B 2071/0683; A63B 2071/0694; A63B 2220/51; A63B 2225/50
See application file for complete search history.

(56) References Cited

U.S. PATENT DOCUMENTS 3,471,145 A * 10/1969 Berger ..... A63B 21/00072 482/112
3,944,221 A * 3/1976 Berkestad ..... A63B 21/4045 482/112
4,290,599 A * 9/1981 Berger ..... A63B 21/00069 482/126
4,643,417 A * 2/1987 Nieman ..... A63B 21/00069 482/46
4,832,335 A * 5/1989 Tong ..... A63B 21/4045 482/112
4,880,230 A 11/1989 Cook
4,951,941 A * 8/1990 Resk ..... A63B 21/4045 482/112
5,044,630 A * 9/1991 Ventimiglia ..... A63B 23/12 482/112
5,069,448 A * 12/1991 Shyu ..... A63B 21/00072 482/112
5,071,119 A 12/1991 Johnson
5,385,524 A * 1/1995 Jahoda ..... A63B 21/4025 482/112
5,529,559 A 6/1996 Punzalan
5,643,160 A * 7/1997 Huang ..... A63B 21/00185 482/125
6,468,190 B1 * 10/2002 Fazio ..... A63B 23/03525 482/114
7,094,182 B1 8/2006 Holten
7,163,495 B2 * 1/2007 Fazio ..... A63B 21/4045 482/111
7,361,126 B2 * 4/2008 Bruce ..... A63B 21/00069 482/121
7,387,598 B2 * 6/2008 Miller ..... A63B 21/4001 482/111
7,569,003 B1 8/2009 Huffman
7,578,773 B2 * 8/2009 Gronda ..... A63B 23/0482 482/111
8,007,418 B2 * 8/2011 LeVert ..... A63B 21/00072 482/112
8,105,214 B2 1/2012 Jahns
8,162,808 B2 * 4/2012 Cook ..... A63B 21/4035 482/112
10,974,087 B1 * 4/2021 Moon ..... A63B 23/1254
2007/0149371 A1 6/2007 Gejdos
2007/0197356 A1 * 8/2007 Miller ..... A63B 21/00072 482/112
2009/0143204 A1 * 6/2009 Gronda ..... A63B 23/1254 482/112
2013/0296145 A1 11/2013 Tomaszewski
2018/0200574 A1 * 7/2018 Connolly ..... A63B 21/028

FOREIGN PATENT DOCUMENTS

DE 2411770 A * 10/1974
DE 20215509 U1 * 1/2003 ..... A63B 21/4035
DE 102016220416 A1 * 4/2018 ..... A63B 21/0004
TW M297258 U * 9/2006
WO WO-0057960 A1 * 10/2000 ..... A63B 21/0004
WO WO-2008109918 A1 * 9/2008 ..... A63B 21/4045

* cited by examiner

VARIABLE FORCE PNEUMATIC EXERCISE STAFF AND METHOD

RELATED APPLICATIONS

This application is a U.S. national stage of PCT International Patent Application No. PCT/US2022/017392 having an international filing date of Feb. 22, 2022, which claims the benefit of U.S. Provisional Application No. 63/153,228 filed Feb. 24, 2021. The contents of the above-identified applications are incorporated by this reference in their entireties for all purposes as if fully set forth herein.

TECHNICAL FIELD

The disclosure herein relates generally to items for use in strength training exercises. More particularly, disclosed herein is an exercise staff and its method of use.

BACKGROUND

Conventional exercise staffs, such as the one disclosed in U.S. Pat. No. 9,126,075, commonly include springs and weights for providing exercise resistance. What is needed is an exercise staff with improvements in resistance adjustability, size adjustability and coupling features.

SUMMARY

Examples of a variable force pneumatic exercise staff and associated methods in accordance with the present disclosure address one or more of the deficiencies of the prior art.

BRIEF DESCRIPTION OF THE DRAWINGS

Further advantages of the present invention may become apparent to those skilled in the art with the benefit of the following detailed description of the preferred embodiments and upon reference to the accompanying drawings in which:

FIGS. 34 and 35 are diagrammatic perspective views showing the user of an example variable force pneumatic exercise staff conveniently adjusting the resistance controller in the middle of an exercise movement without requiring disruption of the grip of each hand on the staff.

DETAILED DESCRIPTION OF THE PREFERRED EMBODIMENTS

Figure 1:
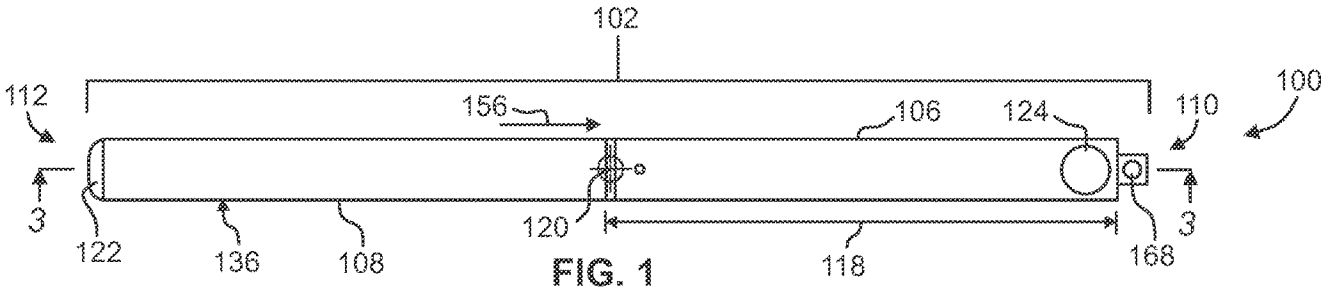
FIG. 1 is a diagrammatic top view of one example variable force pneumatic exercise staff in accordance with the present disclosure, wherein the pneumatic cylinder is shown in a compressed configuration.

Referring now to the drawings, like reference numerals designate identical or corresponding features throughout the several views.

With reference to the several drawings, embodiments of a variable force pneumatic exercise staff are shown generally at 100, and may preferably comprise at least one staff segment 102. The staff segment 102 preferably includes a pneumatic cylinder 106 and a handle element 108.

Referring to FIGS. 1-4, the pneumatic cylinder 106 may be elongated along a longitudinal axis 104. The pneumatic cylinder 106 may have a handle engagement end 114 and a staff first end 110 disposed oppositely of one another along the longitudinal axis 104. A cylinder length 118 may be being defined, for example, by the distance between the handle engagement end 114 and the staff first end 110. The pneumatic cylinder 106 may be actuatable between a compressed configuration (see, for example, FIGS. 1 and 3), and an extended configuration (see, for example, FIGS. 2 and 4) such that the cylinder length 118 is greater in the extended configuration than in the compressed configuration. The cylinder length 118 may preferably be at least 6 inches greater when the pneumatic cylinder 106 is in the extended configuration than when the pneumatic cylinder 106 is in the compressed configuration.

Figure 11:
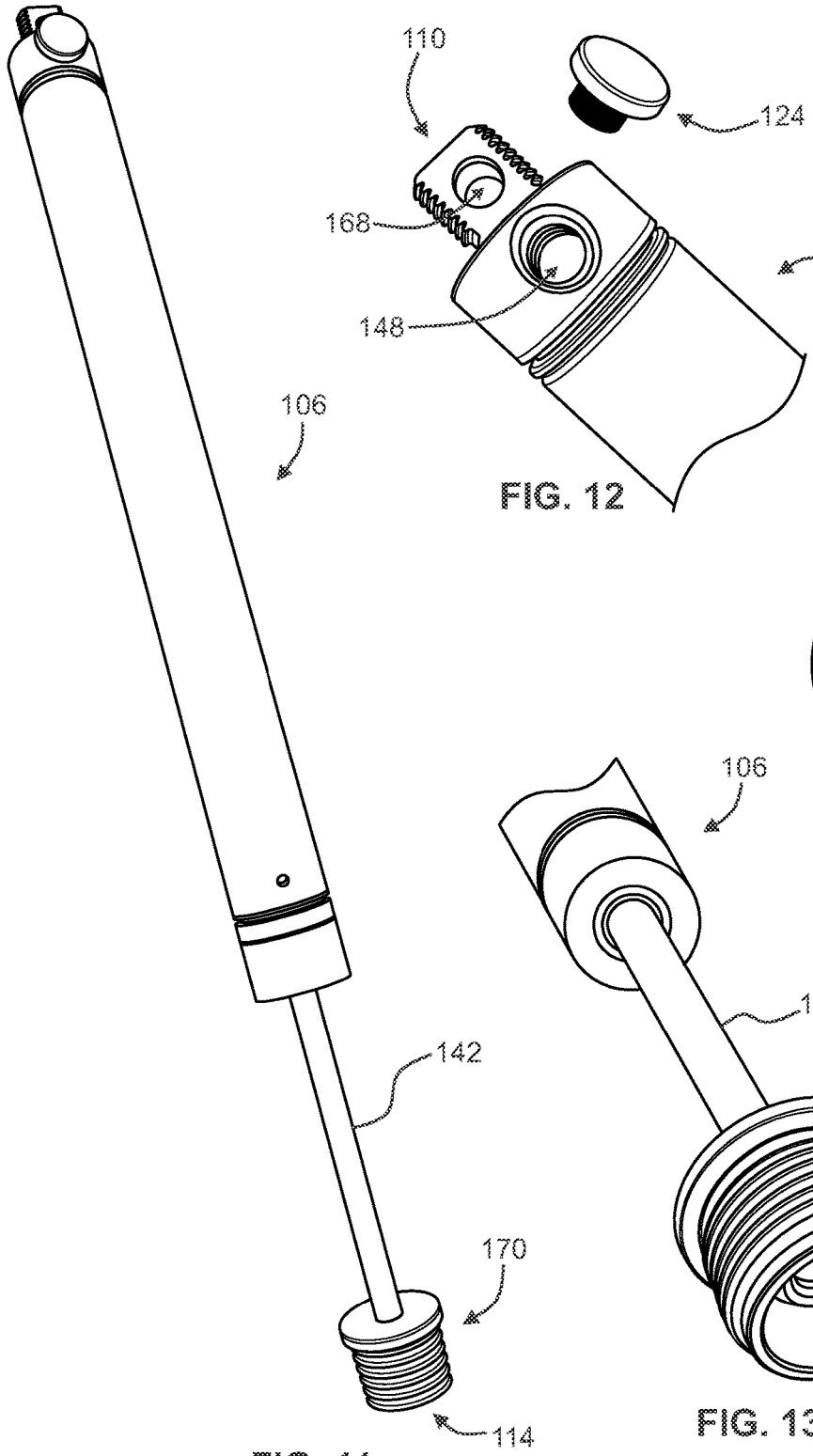
FIG. 11 is a diagrammatic perspective view of one example pneumatic cylinder shown in an extended configuration.
Figure 12:
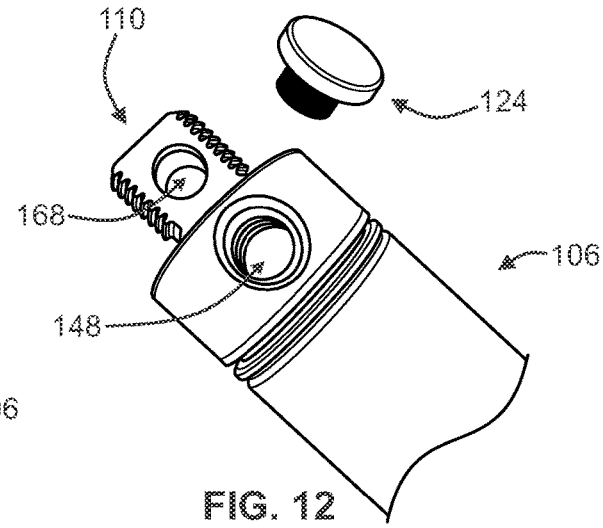
FIG. 12 is a diagrammatic partial perspective view of the of one example variable force pneumatic exercise staff, wherein the resistance controller is shown having been threadedly removed from the resistance control port.
Figure 13:
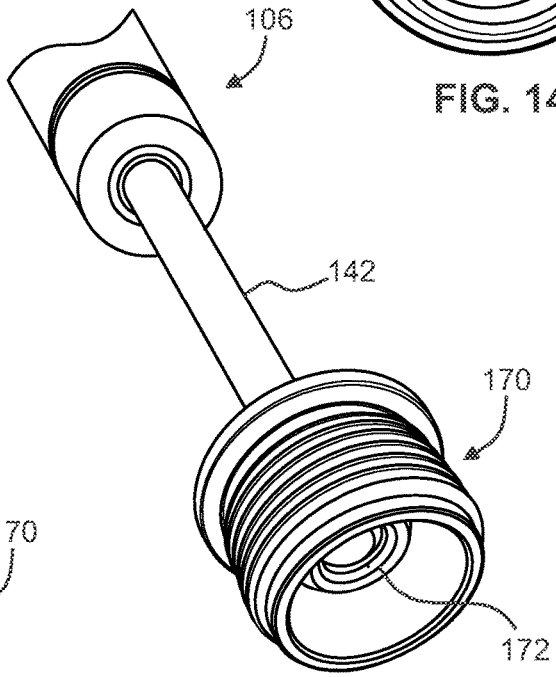
FIG. 13 is a diagrammatic partial perspective view of one example variable force pneumatic exercise staff, showing an example of a handle interface element affixed to the piston rod of the pneumatic cylinder by way of a handle interface fastener.
Figure 14:
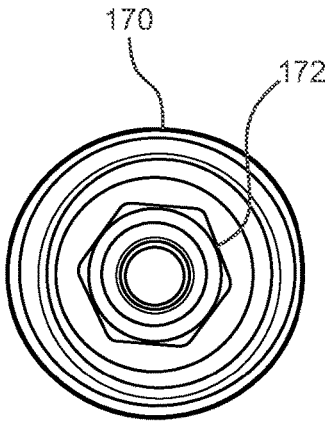
FIG. 14 is a diagrammatic end view of the handle interface element and handle interface fastener of FIG. 13.

The handle element 108 may be affixed to the handle engagement end 114. For example, a handle interface element 170 may be affixed to the piston rod 142 and configured to threadedly engage the handle element 108 (e.g., as shown in FIGS. 11 and 13). Alternatively or in addition, referring to FIGS. 39-42, the handle interface element 170 may include spring-biased pins 206 configured to selectively laterally-engage corresponding pin engagement apertures 208 in the handle element 108. In certain such embodiments of the staff 100, this allows a user to conveniently and selectively adjust the overall length of the staff 100. A pin spring 210 may be provided to provide the spring biasing of the spring biased pin 206, and the spring bias may be configured to be overcome by application of a pin force $F_b$ by a user. It is further envisioned that other length-adjustable connection mechanisms may be used to adjustably affix the handle interface element 170 to the handle element 108.

Figure 3:
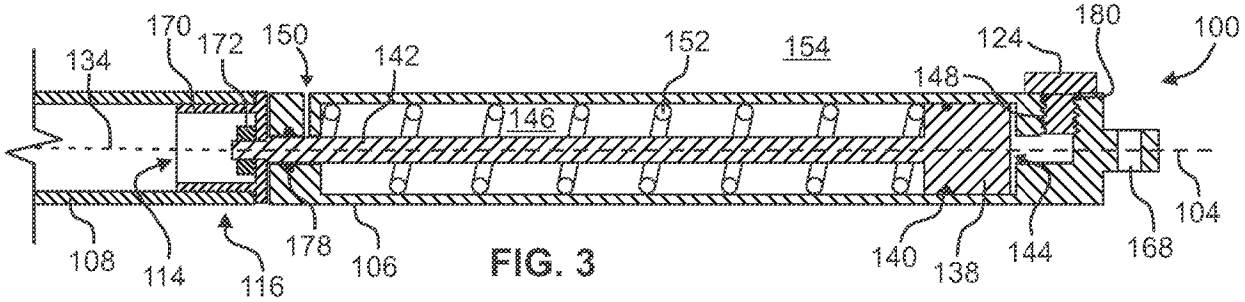
FIG. 3 is a diagrammatic partial cross-sectional view taken along lines 3-3 of FIG. 1.
Figure 23:
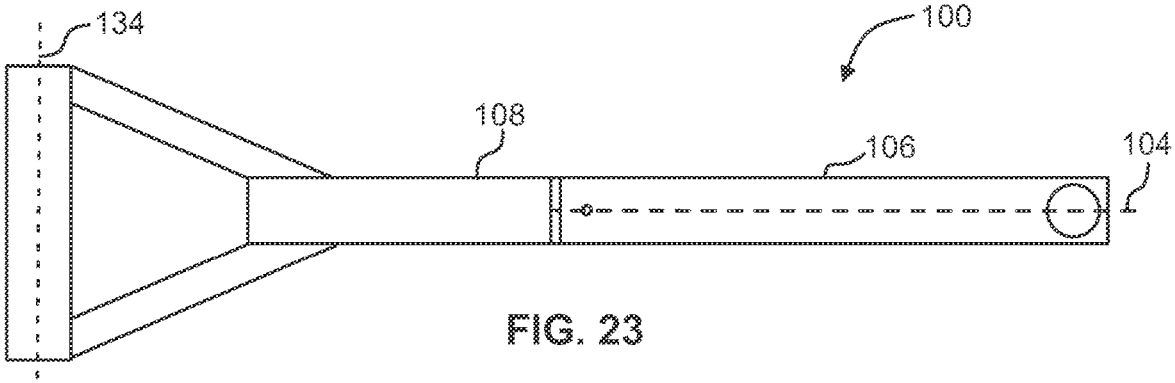
FIG. 23 is a diagrammatic side view of one alternate example variable force pneumatic exercise staff in accordance with the present disclosure, wherein the handle element defines a grip axis extending perpendicularly to the longitudinal axis of the pneumatic cylinder.

Referring to FIG. 3, the handle element 108 may define a grip axis 134 extending parallel to the longitudinal axis 104. In the alternative, referring to FIG. 23, the handle element 108 may define a grip axis 134 extending perpendicularly to the longitudinal axis 104. The handle element 108 may optionally include a hand grip surface 136 which is frictionally enhanced. Such frictional enhancement may be by way of, for example, frictional a rubber coating, cloth tape or knurling. The handle element 108 may preferably be configured to be rotatable about the longitudinal axis 104 with respect to the pneumatic cylinder 106. Preferably, the rotatability is unrestricted, allowing continuous rotation of the handle element 108 in either direction about the longitudinal axis 104 with respect to the pneumatic cylinder 106. The handle element 108 may include an end cap element 122 which may be selected or modified based upon aesthetic or functional objectives. By way of example, the end cap element 122 may be selectably replaceable with heavier or lighter versions of the end cap element 122, depending upon how the user wishes to adjust the center of gravity of the staff 100.

The pneumatic cylinder 106 may is configured to user-adjustably provide (i) an extension resistance force 162 for resisting the actuation of the pneumatic cylinder 106 toward the extended configuration, and (ii) a compression resistance force 160 for resisting the actuation of the pneumatic cylinder 106 toward the compressed configuration.

Figure 4:
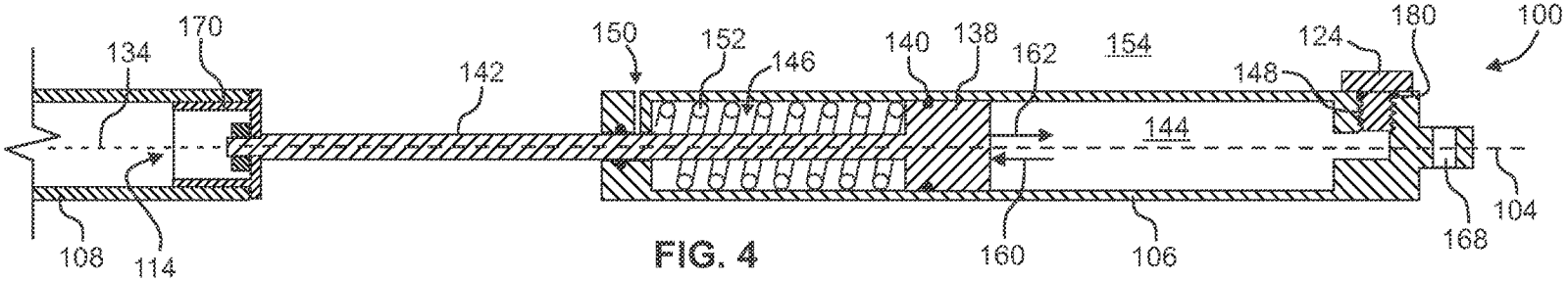
FIG. 4 is a diagrammatic partial cross-sectional view taken along lines 4-4 of FIG. 2.
Figure 6:
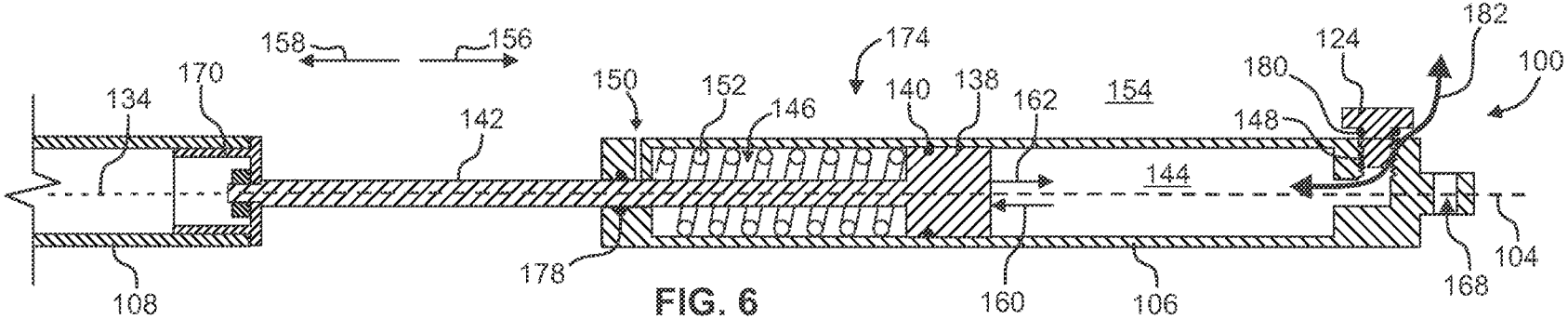
FIG. 6 is a diagrammatic partial cross-sectional view similar to that of FIG. 4, but wherein the resistance controller is shown threadedly rotated into a partially open state in order to enable air to restrictedly flow between the proximal chamber and the ambient environment.

Particular embodiments of the pneumatic cylinder 106 may include a resistance controller 124 configured to allow a user 200 of the variable force pneumatic exercise staff 100 to manually adjust the extension resistance force 162 and the compression resistance force 160. Such manual adjustment may be by way of, for example, rotation of the resistance controller 124. Referring to FIG. 6 for example, threaded rotation of the example resistance controller 124 in a counter-clockwise direction may transport the resistance controller 124 from fully sealing engagement with resistance control port 148 (as shown in FIG. 4) to at least partially open the control port 148 to fluid communication with the ambient environment 154 (as shown in FIG. 6). This allows the user to conveniently and selectively restrict the airflow 182 between the ambient environment 154 and the proximal chamber 144 of the pneumatic cylinder 106. This, in turn allows the user to set the amount of extension and/or compression resistance provided by the pneumatic cylinder 106, and the starting configuration for that resistance.

In particular embodiments of a variable force pneumatic exercise staff 100, the resistance controller 124 may be in the form of a rotating lever, or a manually-actuatable pump (e.g., pressable resilient pump membrane). Moreover, a resistance controller 124 may include, for example, a dial, +/−symbology or color coding to visually indicate its position. Furthermore, certain implementations of a resistance controller 124 may feature tactile detents which allow the user to determine and set the rotational orientation of the resistance controller 124 by feel.

By way of one particular example, if the user would like the exercise staff 100 to provide increased resistance against the user's compression movement (e.g., in compression direction 156), the user may open the resistance control port 148 by turning the resistance controller 124 counterclockwise, move the pneumatic cylinder 106 toward the extended position, then close the control port 124 partially or fully by turning the resistance controller 124 clockwise. This process partially or fully traps a volume of air within the proximal chamber, thereby increasing the amount of compression force required to move the pneumatic cylinder 106 toward the compressed configuration during the exercise.

Similarly, if the user would like the exercise staff 100 to provide increased resistance against the user's extension movement (e.g., in extension direction 158), the user may open the resistance control port 148 by turning the resistance controller 124 counterclockwise, move the pneumatic cylinder 106 toward the compressed position, then close the control port 124 partially or fully by turning the resistance controller 124 clockwise. This process partially or fully removes air from the proximal chamber 144, and hinders air from entering the proximal chamber during the exercise, thereby increasing the amount of extension force required to move the pneumatic cylinder 106 toward the extension configuration during the exercise.

Figure 7:
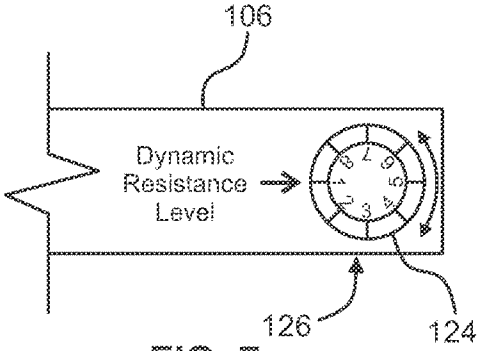
FIG. 7 is a diagrammatic partial top view of one example variable force pneumatic exercise staff, wherein the staff includes an example resistance setting indicator associated with an example resistance controller.
Figure 10:
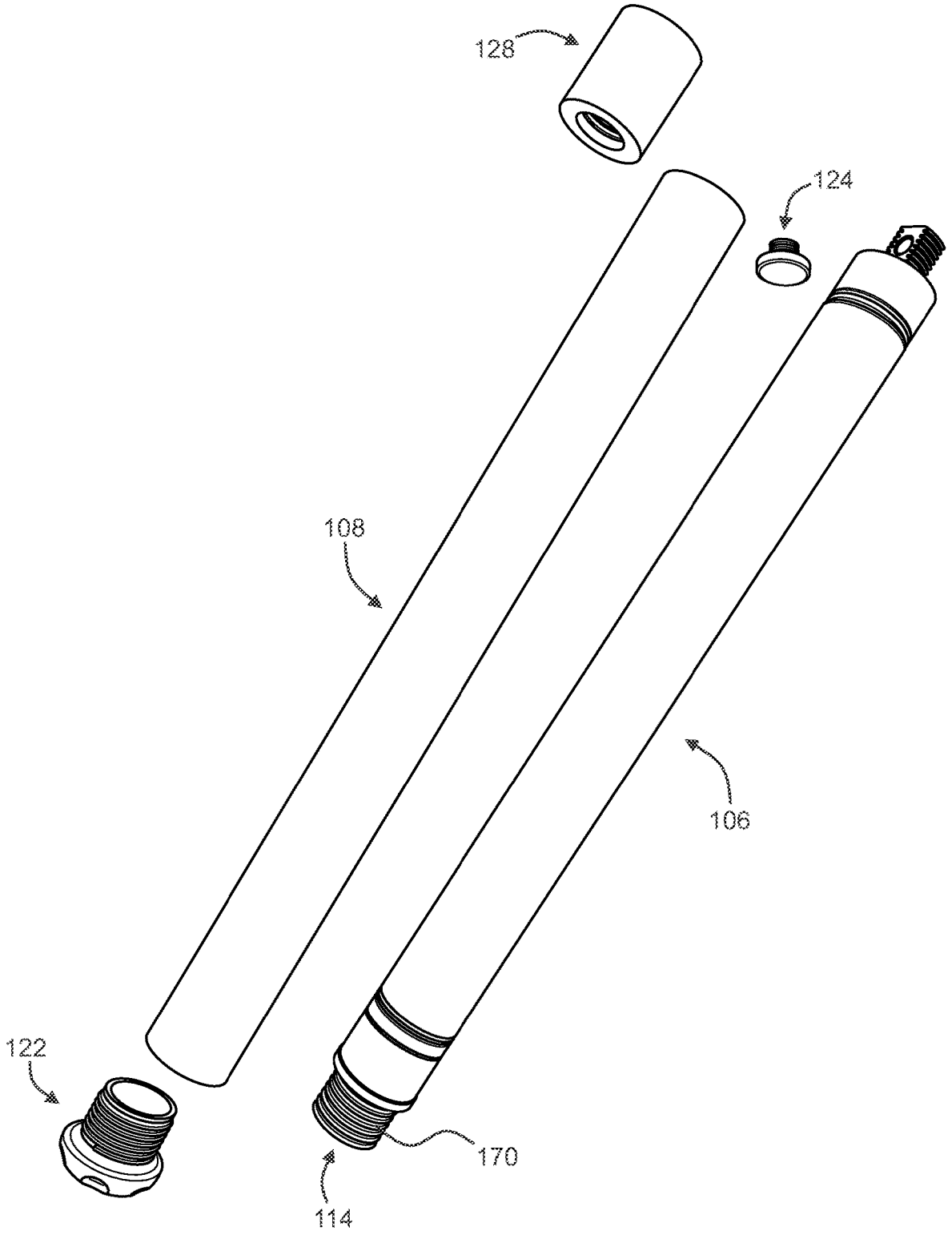
FIG. 10 is a diagrammatic perspective view of one example variable force pneumatic exercise staff shown in a disassembled state.

Referring to FIG. 7, certain embodiments of the variable force pneumatic exercise staff 100 may further comprise a setting indicator 126 configured to visibly indicate, for example, the position of the resistance controller 124. Moreover, the exercise staff 100 may be configured to include a computer processor element and associated electronics allowing the resistance controller 124 to be operated from, or its position transmitted to, a software application operating on a user's mobile computing device. Such control or communication may be by way of, for example, Bluetooth.

Figure 8:
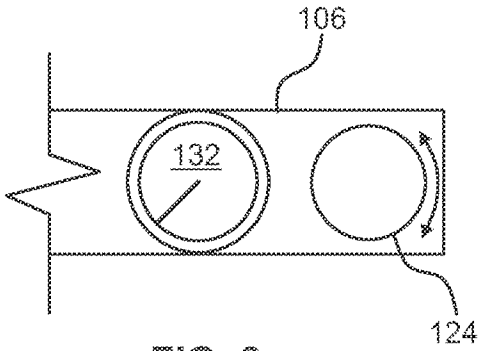
FIG. 8 is a diagrammatic partial top view of one example variable force pneumatic exercise staff, wherein the staff includes an example pressure gauge which may be in pressure communication with, for example, the proximal chamber of the pneumatic cylinder.

Referring to FIG. 8, particular embodiments of the variable force pneumatic exercise staff 100 may further comprise a pressure gauge 132 operably connected to the pneumatic cylinder 106 (e.g., in pressure-sensing communication with the proximal chamber 144). Alternatively or in addition, the exercise staff 100 may be configured to include a computer processor element and associated electronics allowing data from the pressure sensor to be transmitted to a software application operating on a user's mobile computing device (e.g., cell phone or tablet) for display of the pressure data thereon. Such transmission may be by way of, for example, Bluetooth.

Figure 9:
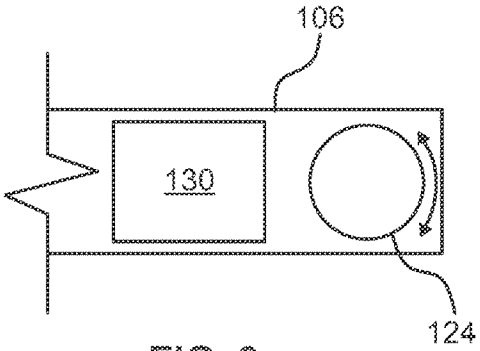
FIG. 9 is a diagrammatic partial top view of one example variable force pneumatic exercise staff, wherein the staff includes an example dynamometer to measure and indicate the power of the user using the staff.

Referring to FIG. 9, certain embodiments of the variable force pneumatic exercise staff 100 may further comprise a dynamometer 130 operably connected to the pneumatic cylinder 106. Moreover, the exercise staff 100 may be configured to include a computer processor element and associated electronics allowing data from the dynamometer 130 to be transmitted to a software application operating on a user's mobile computing device for display of the dynamometer data thereon. Such transmission may be by way of, for example, Bluetooth.

Figure 15:
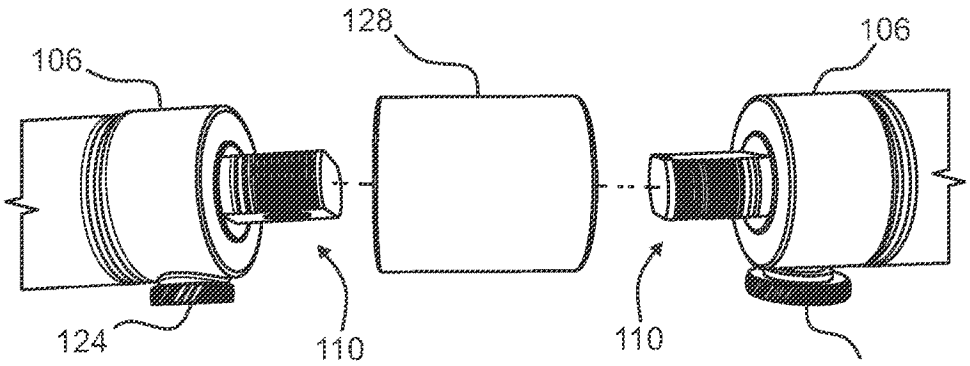
FIG. 15 is a diagrammatic partial perspective view illustrating staff first ends of respective staff segments being coupled together by mutual threaded engagement with a staff segment coupler.
Figure 16:
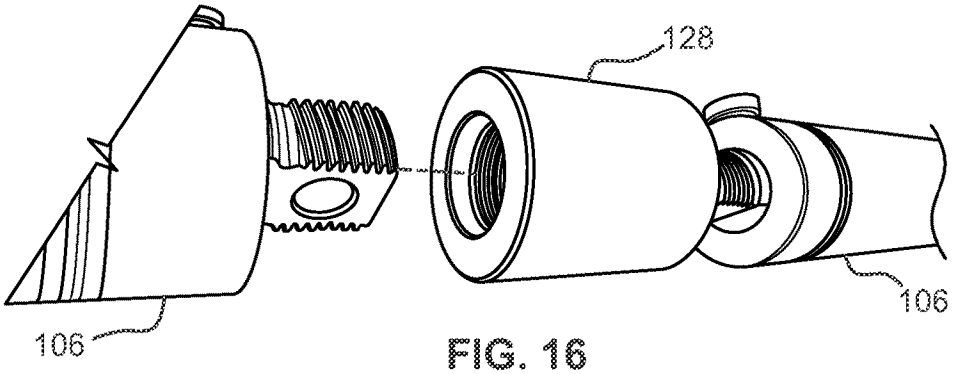
FIG. 16 is a further diagrammatic partial perspective view illustrating staff first ends of respective staff segments being coupled together by mutual threaded engagement with a staff segment coupler.
Figure 17:
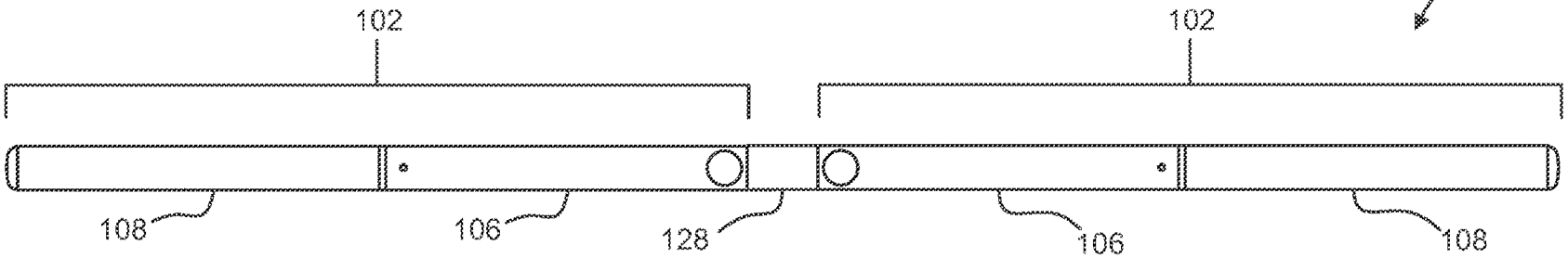
FIG. 17 is a diagrammatic top view of one example variable force pneumatic exercise staff comprising two staff segments rigidly coupled together by way of a segment coupler.
Figure 18:
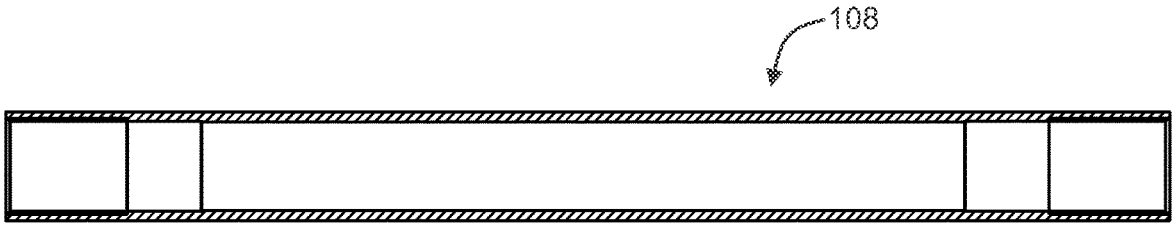
FIG. 18 is a diagrammatic cross-sectional view of one example handle element.
Figure 19:
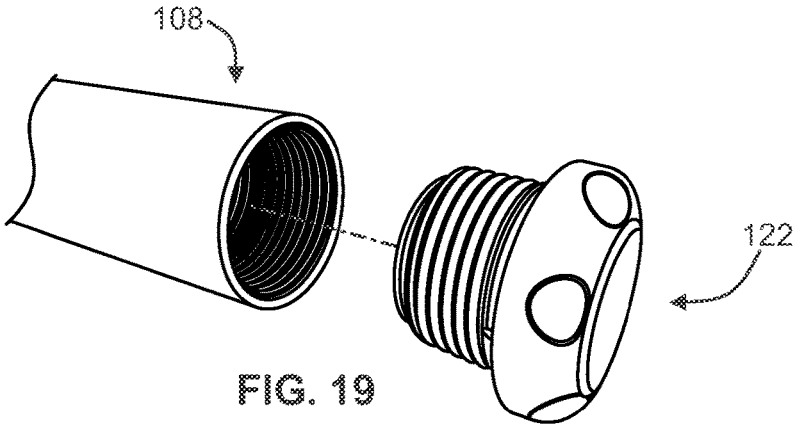
FIG. 19 is a diagrammatic perspective view of one example end cap element being threadedly attached to an example handle element.
Figure 20:
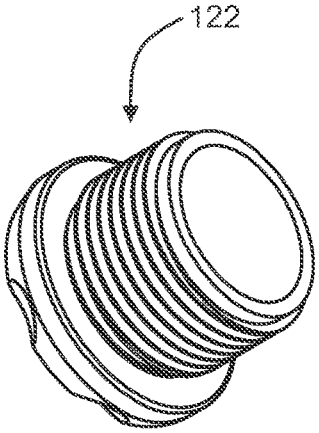
FIG. 20 is a diagrammatic perspective view of one example end cap element.
Figure 21:
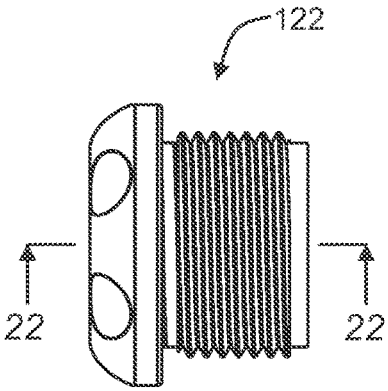
FIG. 21 is a diagrammatic side view of the example end cap element of FIG. 20.
Figure 22:
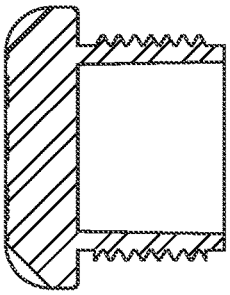
FIG. 22 is a diagrammatic cross-sectional view taken along lines 22-22 of FIG. 21.

Referring to FIGS. 15-17, particular embodiments of the variable force pneumatic exercise staff 100 may further comprise a segment coupler 128 configured to rigidly couple two staff segments 102 to one another. This would result in an exercise staff 100 which is larger and may advantageously facilitate additional resistance and non-resistance exercises. The segment coupler 128 may be configured to threadedly receive the staff first end 110 of each said staff segment 102. Such embodiments of the staff 100 may allow the coupled staff segments 102 to be quickly and easily decoupled from one another, thereby reducing their footprint for ease of storage and transportation.

Referring to FIGS. 3 and 4, in certain embodiments of a variable force pneumatic exercise staff 100, the pneumatic cylinder 106 may be resiliently biased toward the compressed configuration. Such resilient bias may be provided by way of, for example, a compression spring 152. In particular such embodiments, the resilient bias may be sufficient to autonomously return the pneumatic cylinder 106 from the extended configuration to the compressed configuration without an application of force along the longitudinal axis 104 by a user 200. The autonomous return may be pneumatically dampened.

Figure 5:
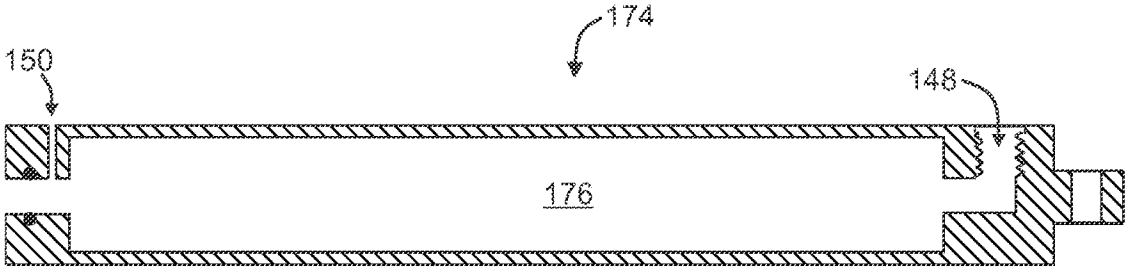
FIG. 5 is a diagrammatic cross-sectional view of an example cylinder housing, as taken along lines 4-4 of FIG. 2.

Referring to FIGS. 5 and 6, in particular embodiments of a variable force pneumatic exercise staff 100, the pneumatic cylinder 106 may include a cylinder housing 174, a piston 138, a piston rod 142 and a resistance controller 124. The cylinder housing 174 may have defined therein a proximal chamber 144 and a distal chamber 146. The piston 138 may be in sealing relationship between the proximal chamber 144 and the distal chamber 146 (e.g., by way of a piston seal eminent 140). The cylinder housing 174 may have a resistance control port 148 and a vent port 150. The resistance control port 148 may be in fluid communication between the proximal chamber 144 and an ambient environment 154. The vent port 150 may be in fluid communication between the distal chamber 146 and the ambient environment 154. The resistance controller 124 may be threadedly received by the resistance control port 148 and may be configured to be rotated to adjust the degree to which the resistance controller 124 seals the proximal chamber 144 from the ambient environment 154, thereby allowing a user of the variable force pneumatic exercise staff 100 to manually adjust the extension resistance force 162 and the compression resistance force 160.

In certain embodiments of the variable force pneumatic exercise staff 100, the staff first end 110 may include an auxiliary aperture 168 extending therethrough perpendicularly to the longitudinal axis 104.

Figure 2:
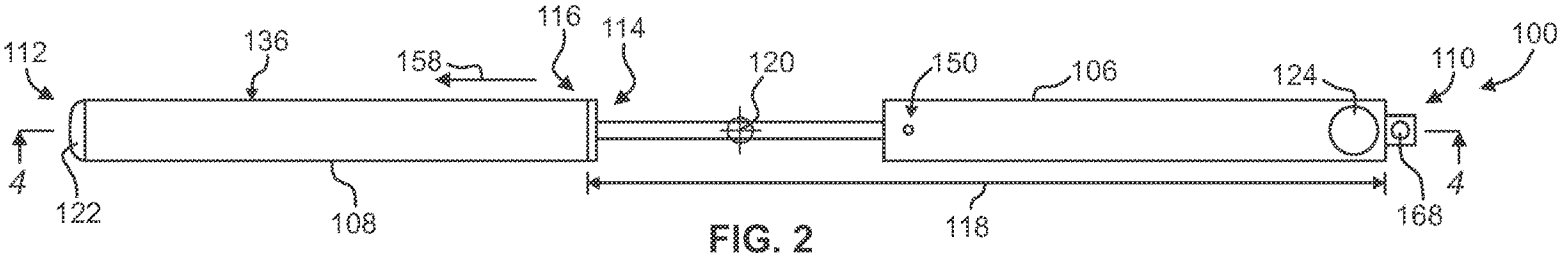
FIG. 2 is a diagrammatic top view of the example variable force pneumatic exercise staff of FIG. 1, but wherein the pneumatic cylinder is shown in an extended configuration.
Figure 38:
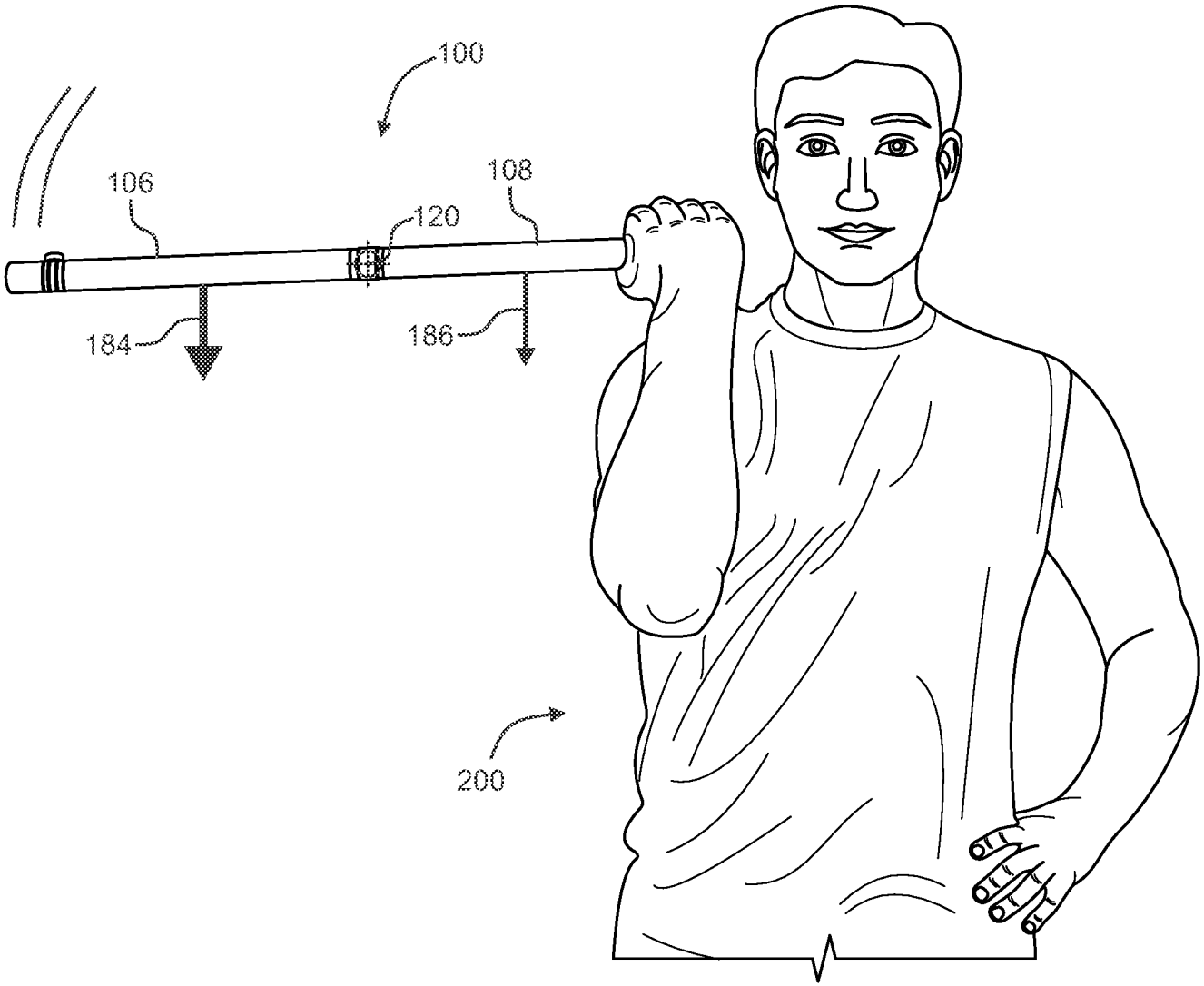
FIG. 38 is diagrammatic view showing the user of an example variable force pneumatic exercise staff demonstrating how asymmetric weighting of the staff about its center point may facilitate warm-up and range-of-motion swinging exercises.
Figure 39:
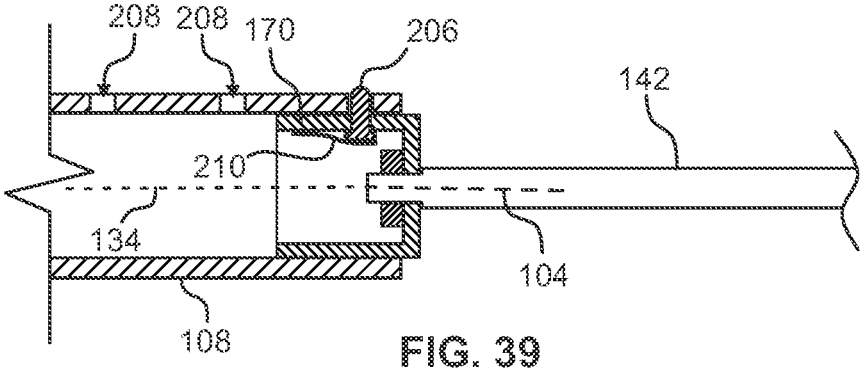
FIG. 39 is a diagrammatic partial cross-sectional view illustrating a example of handle interface element with a spring biased pin for selectably engaging corresponding pin engagement apertures in the handle element, thereby allowing a user to selectively adjust the overall length of the exercise staff.
Figure 40:
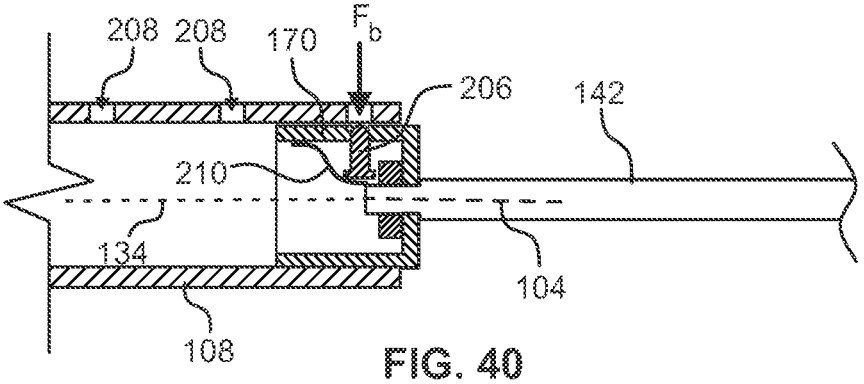
FIG. 40 is a diagrammatic partial cross-sectional view similar to that of FIG. 39, but wherein the spring-biased pin is shown having been inwardly-depressed against the spring bias, thereby allowing the axial position of the handle interface element to be slidably adjusted within the handle element.
Figure 41:
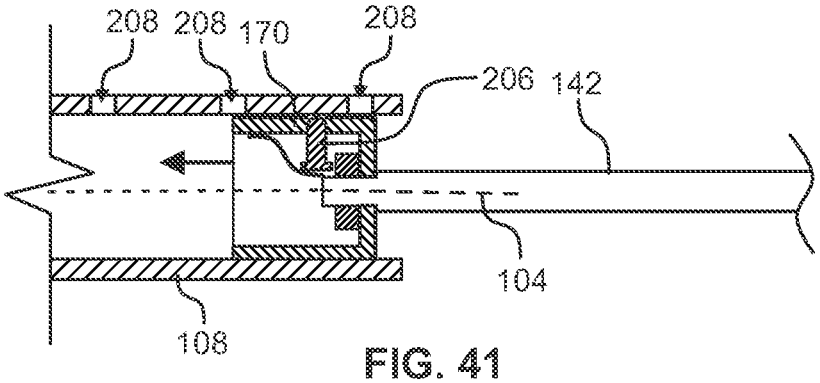
FIG. 41 is a diagrammatic partial cross-sectional view similar to that of FIG. 40, but wherein the axial position of the handle interface element is shown being adjusted within the handle element.
Figure 42:
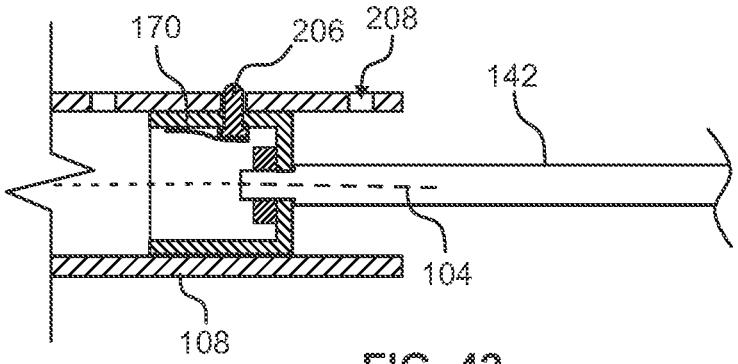
FIG. 42 is a diagrammatic partial cross-sectional view similar to that of FIG. 39, but wherein the axial position of the handle interface element is shown having been locked in a different axial position with respect to the handle element by way of the spring biased pin engaging a different pin engagement aperture in the handle element.

Referring to FIGS. 1, 2 and 38, in particular embodiments of the variable force pneumatic exercise staff 100, (a) the handle element 108 includes a staff second end 112 and a cylinder engagement end 116; (b) the exercise staff 100 includes a center point 120 which may be defined equidistant from the staff first end 110 and the staff second end 112. The variable force pneumatic exercise staff 100 may preferably be asymmetrically weighted about the center point 120. For example, the pneumatic cylinder 106 may be at least three times heavier than the handle element 108. See, for example, FIG. 38, which illustrates an asymmetric loading exercise in which it is helpful for the weight of the pneumatic cylinder 184 is greater than the weight of the handle element 108. Notably, in certain embodiments of the exercise staff 100, the handle element 108 may be configured to receive and retain removable weights therein.

Figure 24:
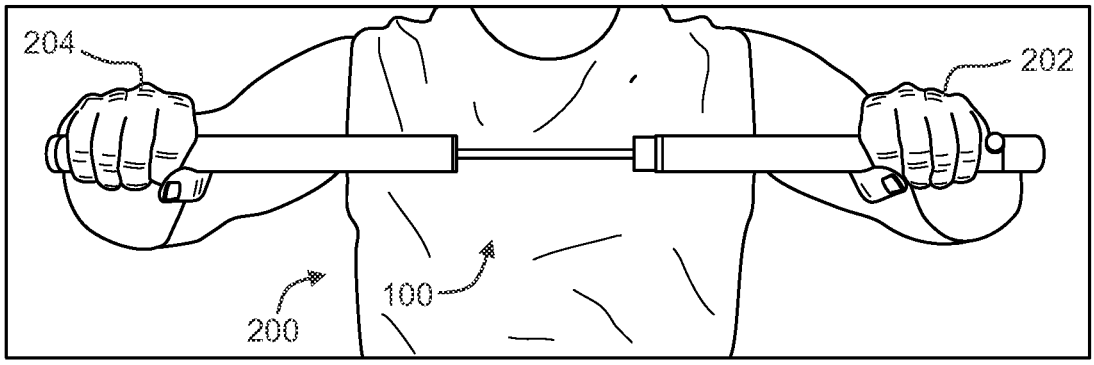
FIGS. 24-29 are diagrammatic front views showing a sequence in which a user is implementing an example method of using a variable force pneumatic exercise staff, and one or more of the compression and extension movements are performed simultaneously with a corresponding outward or inward motion of the user's arms with respect to the user's torso.
Figure 25:
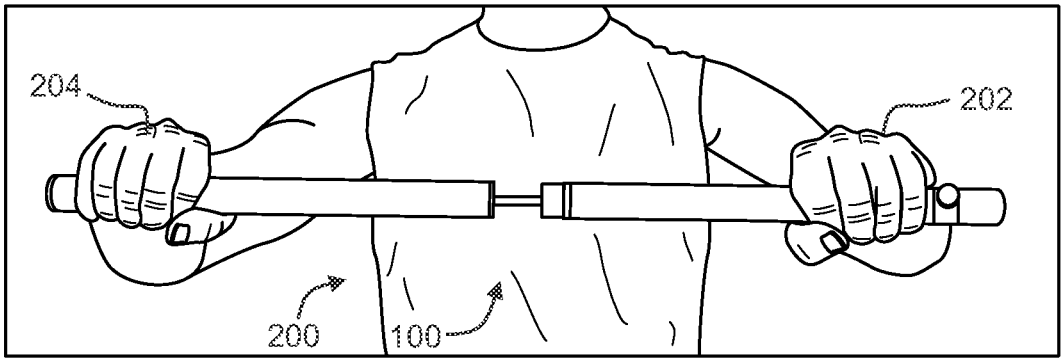
Figure 26:
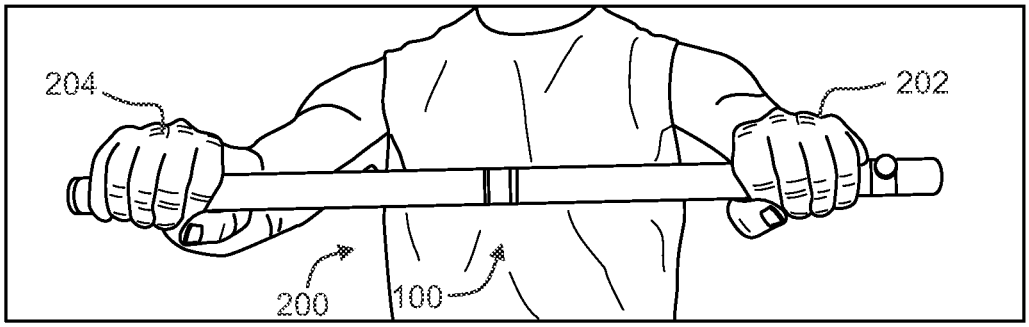
Figure 27:
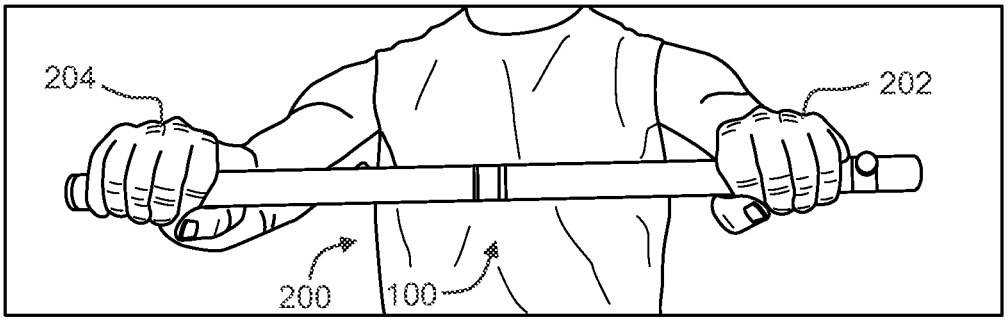
Figure 28:
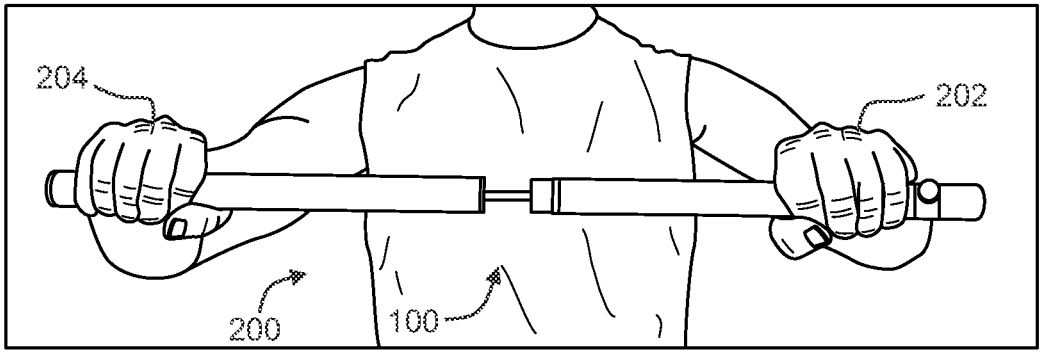
Figure 29:
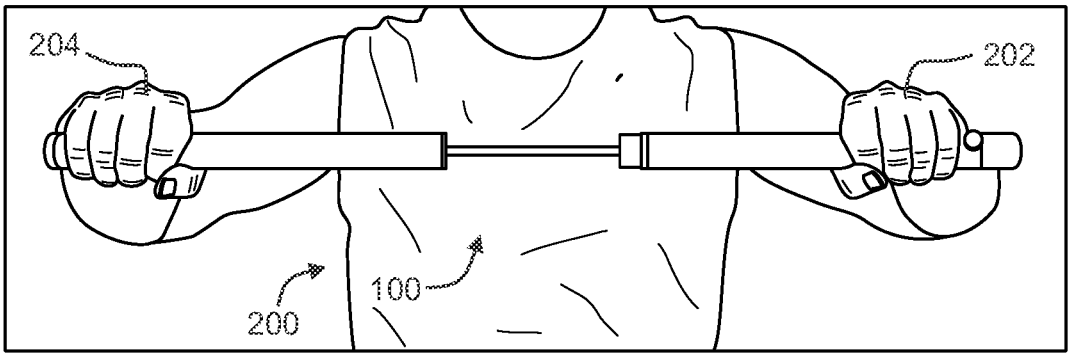

Referring to FIGS. 24-38, methods of using a variable force pneumatic exercise staff 100 may comprise a series of steps. A variable force pneumatic exercise staff 100, such as any one of the embodiments described herein, may be selected. The staff 100 may then be simultaneously grippingly engaged with a first hand 202 of the user 200 and a second hand 204 of the user 200. Referring to FIGS. 24-26, the first hand 202 may be moved toward the second hand 204 during the gripping engagement, thereby causing actuation of the of the pneumatic cylinder 106 toward the compressed configuration. Referring to FIGS. 27-29, the first hand 202 may be moved away from the second hand 204 during the gripping engagement, thereby causing actuation of the of the pneumatic cylinder 106 toward the extended configuration. The gripping engagement may be by way of the pneumatic cylinder 106 being gripped by the first hand 202 and the handle element 108 being gripped by the second hand 204.

Figure 30:
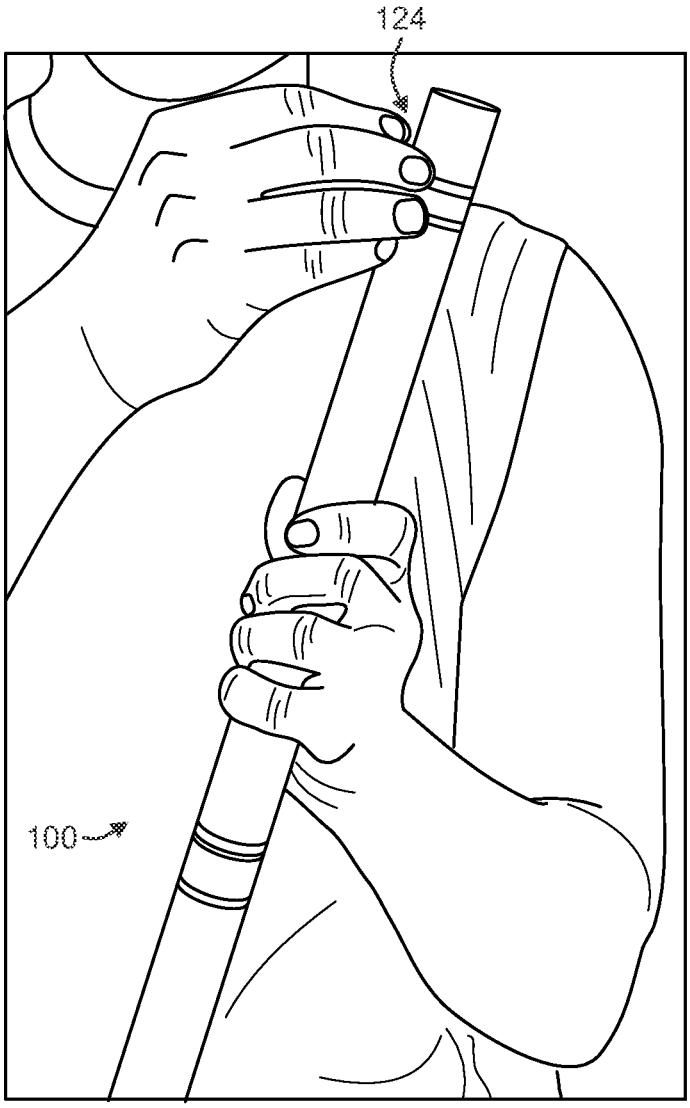
FIG. 30 is a diagrammatic view showing a user manually adjusting the extension resistance force or the compression resistance force of the staff by way of the resistance controller.
Figure 31:
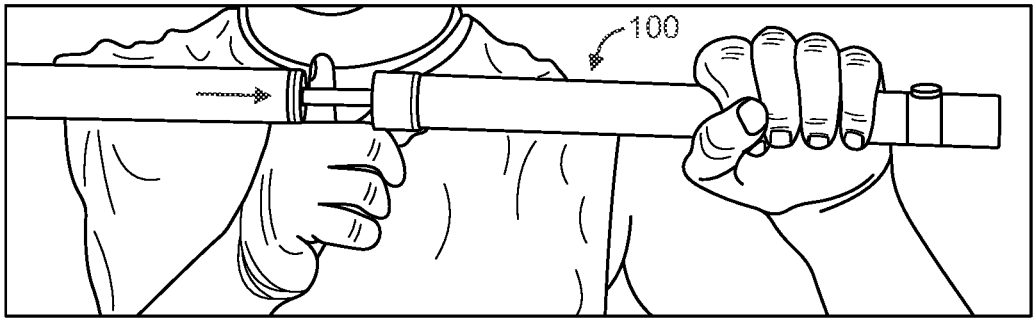
FIG. 31 is a diagrammatic view showing a user demonstrating a safety aspect of the variable force pneumatic exercise staff, wherein the pneumatic cylinder dampens its spring-biased movement toward the compressed configuration, thereby preventing accidental crushing and pinching injuries to adjacent body parts.
Figure 32:
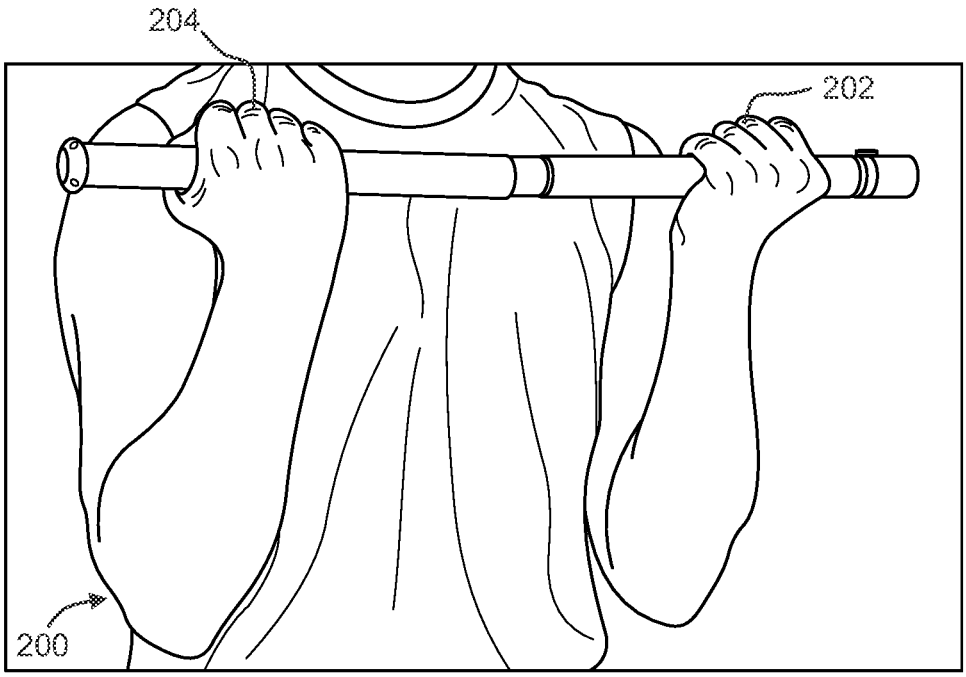
FIGS. 32 and 33 are diagrammatic front views showing an alternate sequence in which a user is implementing an example method of using a variable force pneumatic exercise staff, wherein the compression and extension movements are performed simultaneously with a corresponding bicep motion.
Figure 33:
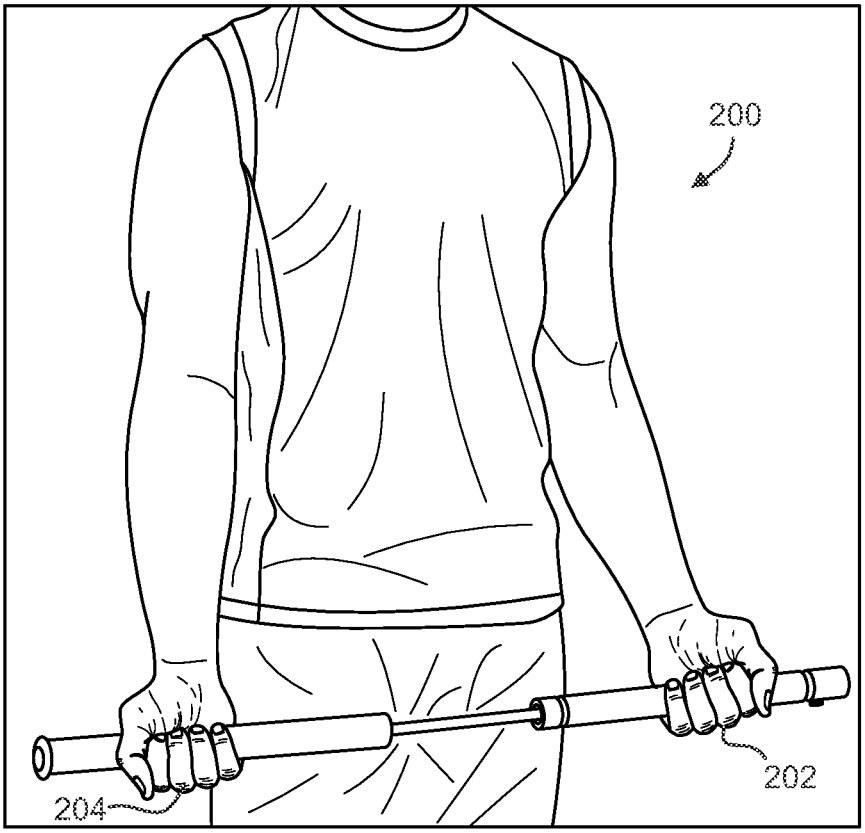
Figure 34:
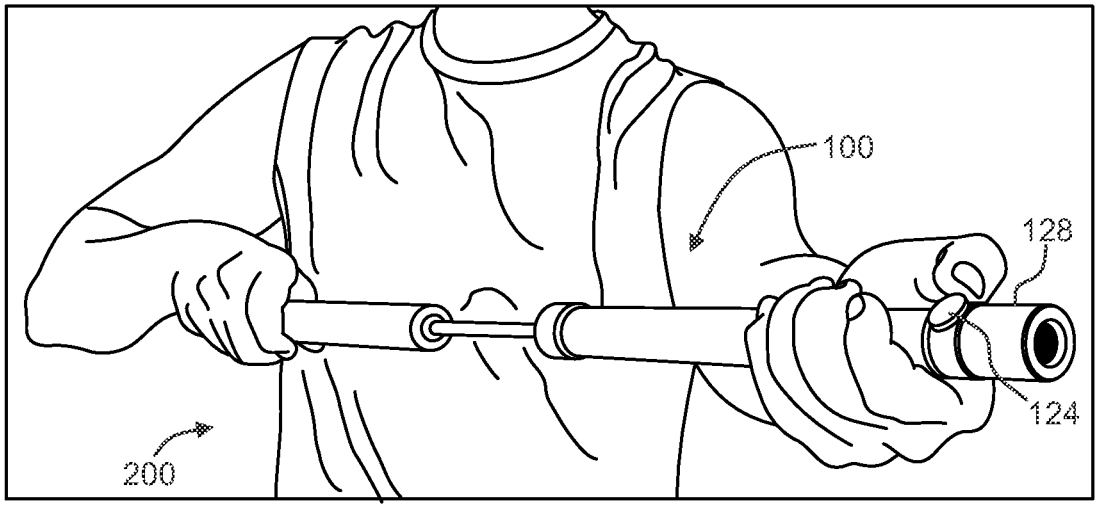
FIGS. 34 and 35 are diagrammatic perspective views showing the user of an example variable force pneumatic exercise staff conveniently adjusting the resistance controller in the middle of a set of exercise repetitions without requiring disruption of the grip of each hand on the staff.
Figure 35:
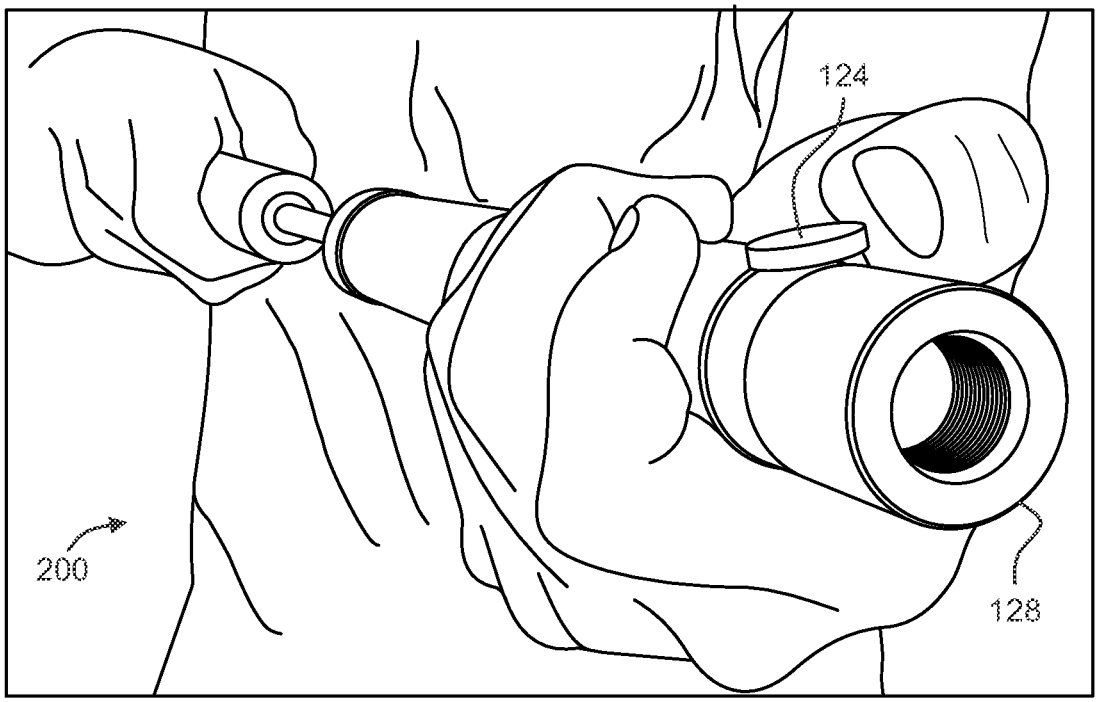
Figure 36:
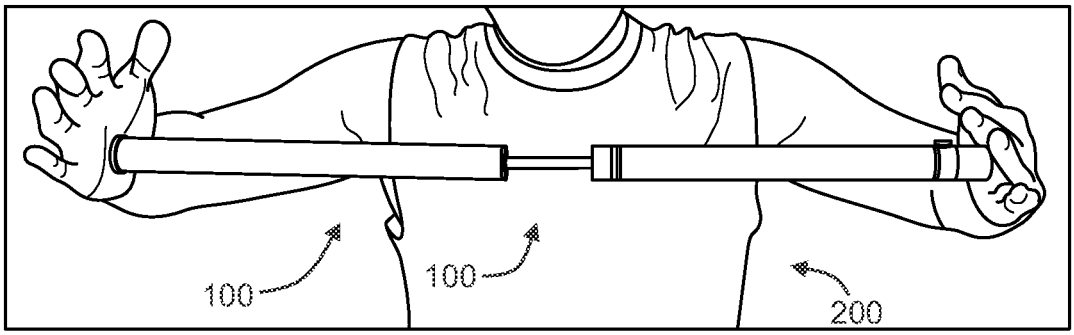
FIG. 36 is diagrammatic view showing the user of an example variable force pneumatic exercise staff applying compressive force on the staff with palms facing one another rather than being gripped around the staff.
Figure 37:
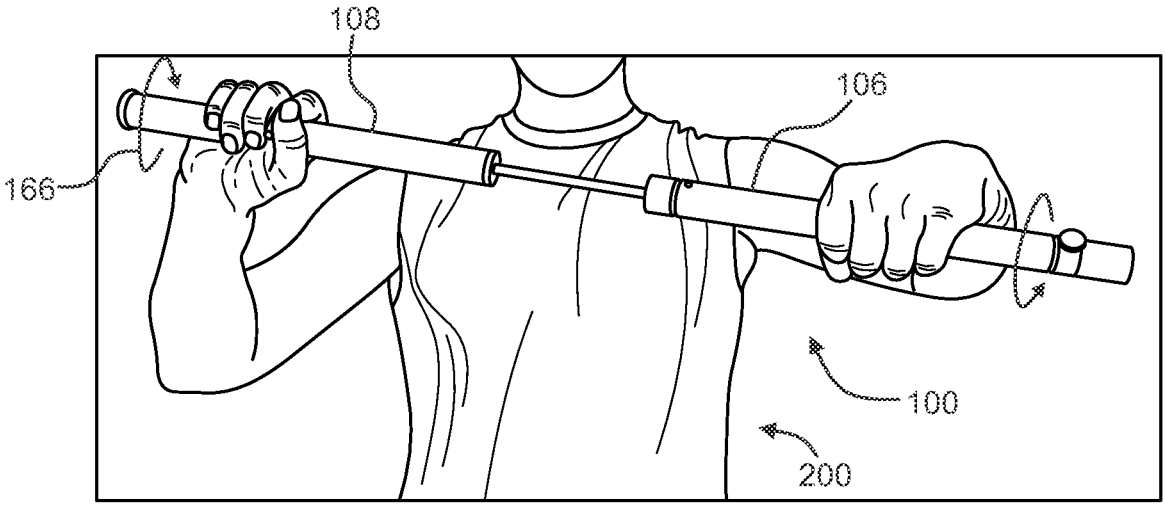
FIG. 37 is diagrammatic view showing the user of an example variable force pneumatic exercise staff demonstrating how compression and extension exercises may be performed simultaneously with a corresponding rotation (e.g., twisting) of the handle element about the longitudinal axis with respect to the pneumatic cylinder.

Referring to FIG. 30, the method of use may further comprise the step of manually adjusting the extension resistance force 162 or the compression resistance force 160 by way of the resistance controller 124.

The method of use may further comprise the step of rigidly coupling the staff segment 102 to a second staff segment 102. Referring to FIGS. 15-17, this rigid coupling may be by way of placing the segment coupler 128 in threaded receipt of the staff first end 110 of each of the two staff segments 102. In such implementations of the method of use, the gripping engagement may be by way of the handle element 108 of each staff segment 102 being gripped by a respective one of the user's hands.

Referring to FIGS. 24-29 and 32-33, in certain implementations of the method of use, each of the compression and/or extension movements may be performed simultaneously with a corresponding outward or inward motion of the user's arms with respect to the user's torso. Alternatively or in addition, referring to FIG. 37, each of the compression and/or extension movements may be performed simultaneously with a corresponding rotation of the handle element 108 about the longitudinal axis 104 with respect to the pneumatic cylinder 106.

The following listing matches certain terminology used within this disclosure with corresponding reference numbers used in the non-limiting examples illustrated in the several figures.

100 variable force exercise staff
102 staff segment (of exercise staff, e.g. first and second segments)
104 longitudinal axis
106 pneumatic cylinder
108 handle element
110 staff first end (e.g., on pneumatic cylinder)
112 staff second end (e.g., on handle portion)
114 handle engagement end (of pneumatic cylinder)
116 cylinder engagement end (of handle portion)
118 cylinder length
120 center point (of exercise staff)
122 end cap element (e.g., at staff second end)
124 resistance controller (e.g., rotatable)
126 resistance setting indicator (e.g., lines on valve screw to make it a dial)
128 segment coupler (e.g., threaded tube coupling first and second staff segments)
130 dynamometer (e.g., to measure and display user power based on use of staff)
132 pressure gauge (e.g., in communication with proximal chamber)
134 grip axis (defined by handle portion)
136 hand grip surface (of handle portion)
138 piston
140 piston seal element
142 piston rod
144 proximal chamber
146 distal chamber
148 resistance control port
150 vent port
152 compression spring
154 ambient environment (defined external to the variable force exercise staff)
156 compression direction
158 extension direction
160 compression resistance force direction (e.g., linear or non-linear force)
162 extension resistance force direction (e.g., linear or non-linear force)
164 cylinder rotation direction
166 handle rotation direction
168 auxiliary aperture
170 handle interface element
172 handle interface fastener (e.g., threaded nut)
174 cylinder housing
176 piston chamber
178 rod seal element (e.g., elastomeric o-ring)
180 resistance seal element (e.g., elastomeric o-ring)
182 resistance setting airflow
184 weight of cylinder
186 weight of handle element
200 user of variable force exercise staff
202 first hand (of the user)
204 second hand (of the user)
206 spring-biased pin
208 pin engagement aperture
210 pin spring
$F_b$ manual depression force on pin While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A variable force pneumatic exercise staff comprising: a staff segment including:

(a) a pneumatic cylinder elongated along a longitudinal axis, the pneumatic cylinder having a handle engagement end and a staff first end disposed oppositely of one another along the longitudinal axis, a cylinder length being defined by a distance between the handle engagement end and the staff first end, the pneumatic cylinder being actuatable between a compressed configuration and an extended configuration such that the cylinder length is greater in the extended configuration than in the compressed configuration; and (b) a handle element affixed to the handle engagement end; wherein the pneumatic cylinder is configured to user-adjustably provide:

(i) an extension resistance force for resisting the actuation toward the extended configuration, and (ii) a compression resistance force for resisting the actuation toward the compressed configuration; and a segment coupler configured to rigidly couple the staff segment to a second said staff segment, wherein the segment coupler is configured to threadedly receive the staff first end of each said staff segment.

2. The variable force pneumatic exercise staff as defined in claim 1, wherein the pneumatic cylinder includes a resistance controller configured to allow a user of the variable force pneumatic exercise staff to manually adjust the extension resistance force and the compression resistance force.

3. The variable force pneumatic exercise staff as defined in claim 2, wherein the manual adjustment is by way of rotation of the resistance controller.

4. The variable force pneumatic exercise staff as defined in claim 3 further comprising a setting indicator configured to visibly indicate a position of the resistance controller.

5. The variable force pneumatic exercise staff as defined in claim 1 further comprising a dynamometer operably connected to the pneumatic cylinder.

6. The variable force pneumatic exercise staff as defined in claim 1 further comprising a pressure gauge operably connected to the pneumatic cylinder.

7. The variable force pneumatic exercise staff as defined in claim 1, wherein the handle element defines a grip axis extending parallel to the longitudinal axis.

8. The variable force pneumatic exercise staff as defined in claim 1, wherein the handle element defines a grip axis extending perpendicularly to the longitudinal axis.

9. The variable force pneumatic exercise staff as defined in claim 1, wherein the handle element includes a hand grip surface which is frictionally enhanced.

10. The variable force pneumatic exercise staff as defined in claim 9, wherein the frictional enhancement is by way of a rubber coating, cloth tape or knurling.

11. The variable force pneumatic exercise staff as defined in claim 1, wherein the pneumatic cylinder is resiliently biased toward the compressed configuration.

12. The variable force pneumatic exercise staff as defined in claim 11, wherein the resilient bias is by way of a compression spring.

13. The variable force pneumatic exercise staff as defined in claim 11, wherein:

(a) the resilient bias is sufficient to autonomously return the pneumatic cylinder from the extended configuration to the compressed configuration without an application of force along the longitudinal axis by a user; and (b) the autonomous return is pneumatically dampened.

14. The variable force pneumatic exercise staff as defined in claim 1, wherein the cylinder length is at least 6 inches greater when the pneumatic cylinder is in the extended configuration than when the pneumatic cylinder is in the compressed configuration.

15. The variable force pneumatic exercise staff as defined in claim 1, wherein the handle element is rotatable about the longitudinal axis with respect to the pneumatic cylinder.

16. The variable force pneumatic exercise staff as defined in claim 15, wherein the rotatability is unrestricted.

17. The variable force pneumatic exercise staff as defined in claim 1, wherein the pneumatic cylinder includes a cylinder housing, a piston, a piston rod and a resistance controller;

wherein the cylinder housing has (a) defined therein a proximal chamber and a distal chamber, wherein the piston is in sealing relationship between the proximal chamber and the distal chamber, (b) a resistance control port in fluid communication between the proximal chamber and an ambient environment, and (c) a vent port in fluid communication between the distal chamber and the ambient environment; and wherein the resistance controller is threadedly received by the resistance control port and is configured to be rotated to adjust a degree to which the resistance controller seals the proximal chamber from the ambient environment, thereby allowing a user of the variable force pneumatic exercise staff to manually adjust the extension resistance force and the compression resistance force.

18. The variable force pneumatic exercise staff as defined in claim 17, further comprising a second said staff segment.

19. The variable force pneumatic exercise staff as defined in claim 1, wherein the staff first end includes an auxiliary aperture extending therethrough perpendicularly to the longitudinal axis.

20. The variable force pneumatic exercise staff as defined in claim 1, wherein:

(a) the handle element includes a staff second end and a cylinder engagement end;

(b) the variable force pneumatic exercise staff includes a center point defined equidistant from the staff first end and the staff second end; and (c) the variable force pneumatic exercise staff is asymmetrically weighted about the center point.

21. The variable force pneumatic exercise staff as defined in claim 1, wherein the pneumatic cylinder is at least three times heavier than the handle element.

22. A method of using a variable force pneumatic exercise staff, the method comprising:

selecting the variable force pneumatic exercise staff, the variable force pneumatic exercise staff comprising a segment coupler and a staff segment, the staff segment including:

(a) a pneumatic cylinder elongated along a longitudinal axis, the pneumatic cylinder having a handle engagement end and a staff first end disposed oppositely of one another along the longitudinal axis, a cylinder length being defined by a distance between the handle engagement end and the staff first end, the pneumatic cylinder being actuatable between a compressed configuration and an extended configuration such that the cylinder length is greater in the extended configuration than in the compressed configuration; and (b) a handle element affixed to the handle engagement end;

wherein the pneumatic cylinder is configured to provide:

(i) an extension resistance force for resisting the actuation toward the extended configuration, and (ii) a compression resistance force for resisting the actuation toward the compressed configuration;

grippingly engaging the variable force pneumatic exercise staff simultaneously with a first hand of a user and a second hand of the user;

moving the first hand toward the second hand during said gripping engagement, thereby causing actuation of the pneumatic cylinder toward the compressed configuration;

moving the first hand away from the second hand during said gripping engagement, thereby causing actuation of the pneumatic cylinder toward the extended configuration; and rigidly coupling the staff segment to a second said staff segment, wherein the rigid coupling is by way of placing the segment coupler in threaded receipt of the staff first end of each said staff segment.

23. The method as defined in claim 22, wherein:

the pneumatic cylinder includes a resistance controller; and the method further comprises the step of manually adjusting the extension resistance force or the compression resistance force by way of the resistance controller.

24. The method as defined in claim 22, wherein the gripping engagement is by way of the pneumatic cylinder being gripped by the first hand and the handle element being gripped by the second hand.

25. The method as defined in claim 22, wherein the gripping engagement is by way of the handle element of each said staff segment being gripped by a respective one of said hands.

26. The method as defined in claim 22, wherein each of said movements of the first and second hands is simultaneous with a corresponding outward or inward motion of the arms of the user with respect to a torso of the user.

27. The method as defined in claim 22, wherein each of said movements of the first and second hands is simultaneous with a corresponding rotation of the handle element about the longitudinal axis with respect to the pneumatic cylinder.

* * * * *